US005120458A

United States Patent [19]

Nelson et al.

[11] Patent Number: 5,120,458

[45] Date of Patent: Jun. 9, 1992

[54] PHENYLTRIALKYLSILANE LUBRICATING COMPOSITIONS

[75] Inventors: Gunner E. Nelson; John G. Loop, both of Baton Rouge, La.

[73] Assignee: Ethyl Corporation, Richmond, Va.

[21] Appl. No.: 679,253

[22] Filed: Apr. 2, 1991

Related U.S. Application Data

[63] Continuation-in-part of Ser. No. 636,756, Jan. 2, 1991.

[51] Int. Cl.[5] ..... C10M 139/04

[52] U.S. Cl. ..... 252/49.6; 556/478

[58] Field of Search ..... 252/49.6; 556/489, 478

[56] References Cited

U.S. PATENT DOCUMENTS 4,711,965 12/1987 Nelson ..... 556/478
4,946,980 8/1990 Halm ..... 556/478
4,973,724 11/1990 Nelson ..... 252/49.6

FOREIGN PATENT DOCUMENTS 0573906 12/1945 United Kingdom .

OTHER PUBLICATIONS

Meen and Gilman, "Tetra substituted Higher Aliphatic and Phenyl Silanes", *Journal of Organic Chemistry*, Feb., 1958 pp. 314–316.

*Primary Examiner*—Prince Willis, Jr.
*Assistant Examiner*—Thomas Steinberg
*Attorney, Agent, or Firm*—David E. LaRose; Terry B. Morris

[57] ABSTRACT

Improved silahydrocarbon mixtures comprising phenyltrialkylsilanes wherein the alkyl groups independently are hydrocarbon chains having from about 4 to about 20 carbon atoms, preferably each independent alkyl group differing from the other by no more than about 2 carbon atoms, are produced having unexpectedly good resistance to oxidation and having use in lubrication compositions.

7 Claims, 1 Drawing Sheet

PHENYLTRIALKYLSILANE LUBRICATING COMPOSITIONS

CROSS-REFERENCE TO RELATED APPLICATIONS AND PATENTS

This application is a continuation-in-part of application Ser. No. 636,756, filed Jan. 2, 1991. Said application Ser. No. 636,756 is expressely incorporated herein its entirety by reference.

BACKGROUND

The above referenced parent application relates to various methods for the preparation of synthetic silahydrocarbons. Such methods include the production of a desired ratio of phenyldialkylsilanes to phenyltrialkylsilanes by effective control of certain reaction parameters. The silahydrocarbons produced in such methods have valued use in the formulation of hydraulic fluids and lubricants, among other uses. Improved silahydrocarbon mixtures for such uses remain desireable.

SUMMARY OF THE INVENTION

Figure 1:
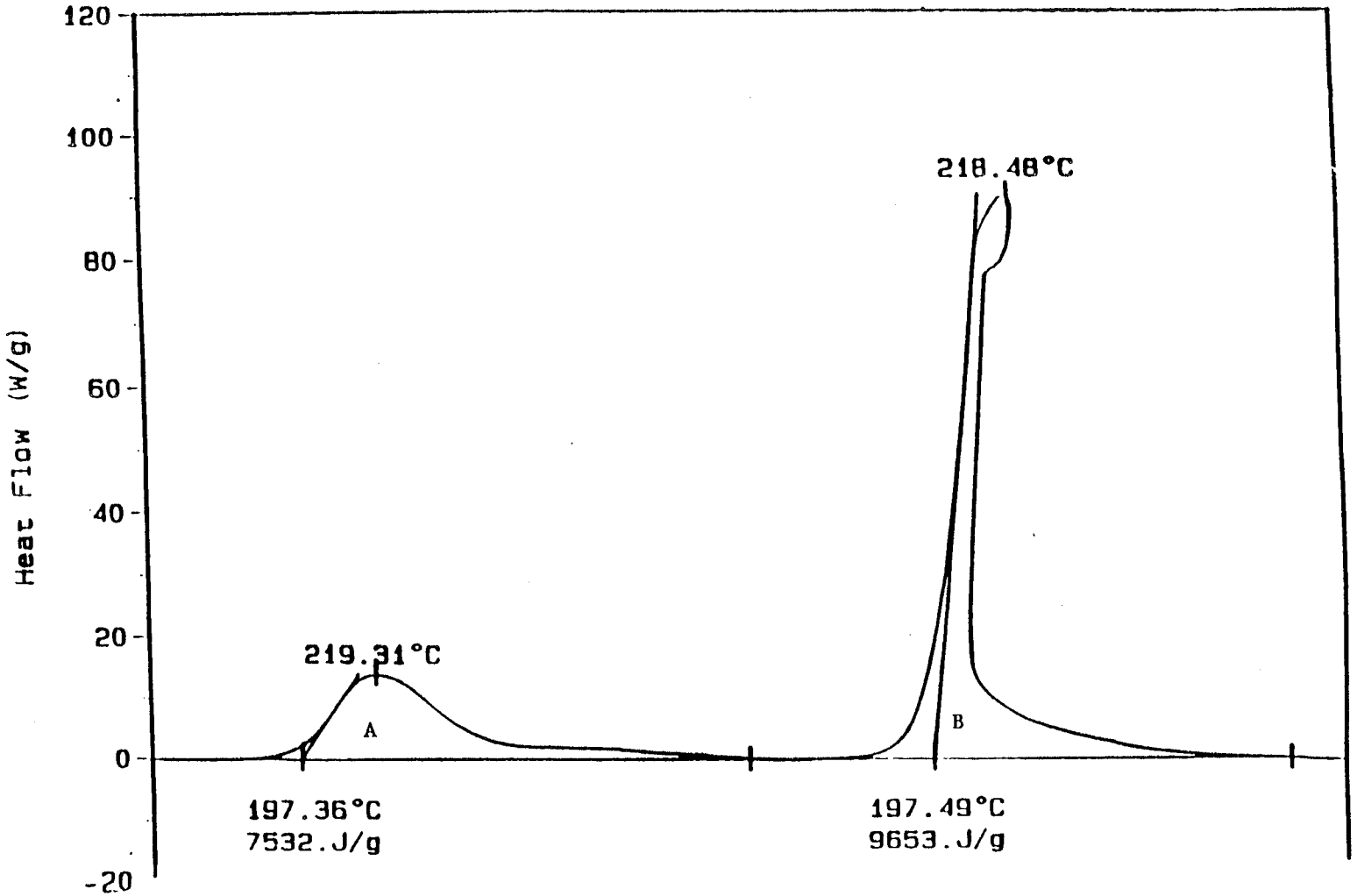
FIG. 1 is graph of a differential scanning calorimetry analysis of samples of a phenyl trialkylsilane mixture and a methyltrialkylsilane mixture. The figure illustrates relative energy release rates of the two mixtures.

Improved silahydrocarbon mixtures have been discovered which have unexpectedly good properties for use in lubrication compositions. Such silahydrocarbon mixtures comprise phenyltrialkylsilane wherein the alkyl groups independently are hydrocarbon chains having from about 4 to about 20 carbon atoms.

DESCRIPTION OF THE PREFERRED EMBODIMENTS

An embodiment of the present invention is a lubrication composition comprising a phenyltrialkylsilane wherein the alkyl groups independently are hydrocarbon chains comprising from about four to about twenty carbon atoms, more preferably from about six to about twelve carbon atoms each. Such alkyl groups preferrably are saturated hydrocarbon chains, more preferrably such chains are normal, linear hydrocarbon chains. Examples of such alkyl groups are propyl, butyl, pentyl, hexyl, heptyl, octyl, nonyl, decyl, dodecyl, tetradecyl, hexadecyl and higher alkyl groups. Although not preferred, such alkyl groups can additionally have substituents thereto, such as additional alkyl groups so as to constitute branched alkyl groups. Examples, without limitation, of preferred phenyltrialkylsilanes are phenyltrihexylsilane, phenyltrioctylsilane, phenyltridecylsilane, phenyltridodecylsilane, phenyltritetradecylsilane, phenyldihexyloctylsilane, phenylhexyldioctylsilane, phenyldioctyldecylsilane, phenyloctyldidecylsilane, phenyldidecyldodecylsilane, phenyldecyldidodecylsilane, phenyldidodecyltetradecylsilane, phenyldodecylditetradecylsilane, phenylhexyldidecylsilane, phenyldihexyldecylsilane, phenyldecylditetradecylsilane, phenyldidecyltetradecylsilane, phenylhexyldidodecylsilane, phenyldihexyldodecylsilane, phenyloctyldidodecylsilane, phenyldioctyldodecylsilane, phenyloctylditetradecylsilane, phenyldioctyltetradecylsilane, and other combinations of the alkyl groups on the phenylsilane.

Also preferred are compositions comprising a phenyltriaalkylsilane wherein the number of carbon atoms in each independent alkyl group differs by no more than about two carbon atoms per group. Examples of such preferred phenyltrialkylsilanes are phenyltrihexylsilane, phenyltrioctylsilane, phenyltridecylsilane, phenyltridodecylsilane, phenyltritetradecylsilane, phenyldihexyloctylsilane, phenylhexyldioctylsilane, phenyldioctyldecylsilane, phenyloctyldidecylsilane, phenyldidecyldodecylsilane, phenyldecyldidodecylsilane, phenyldodecylditetradecylsilane, and phenyldidodecyltetradecylsilane. The more preferred compositions comprise normal alkyl groups; most preferrably, consist of normal alkyl groups. Also preferred are compositions wherein each alkyl group is independently selected from alkyl groups having from about six to about eight carbon atoms each or from alkyl groups having from about eight to about ten carbon atoms each or from alkyl groups having about ten to about twelve carbon atoms each.

Embodiments of the present invention also include lubricant compositions comprising a mixture of phenyltrialkylsilanes having the formula $RSi(R')_n(R'')_{3-n}$ wherein R is a phenyl group and R' and R'' are each independently selected from normal alkyl groups having from about four to about twenty carbon atoms, more preferably from about four to about sixteen carbon atoms, and n is zero, one, two or three. More preferably, the lubricant composition comprises a mixture of phenyltriaalkylsilanes wherein the number of carbon atoms in R' and R'' differ by about two. Such mixtures can be represented as a mixture comprising $aRSi(R')_3$, $bRSi(R')_2(R'')_1$, $cRSi(R')_1(R'')_2$ and $dRSi(R'')_3$, wherein a, b, c and d represent the ratio of the phenyltriaalkylsilanes in the mixture. Preferably, the values of a and d are approximately equal to each other and the values of b and c are approximately equal to each other and greater than the values of a or d. For example, in one preferred embodiment the ratio a:b:c:d is about 1:0.5 to 15:0.5 to 15:0.5 to 2. More preferably, the ratio a:b:c:d is approximately 1:3:3:1. Such mixtures can additionally comprise minor amounts of by-products created during the synthesis of the desired phenyltrialkylsilane mixtures.

Methods of preparing such lubricant compositions comprising a mixture of phenyltriaalkylsilanes can include those discussed hereinabove and in the material incorporated by reference hereinabove. For instance, such compositions can be prepared from precursor material comprising tetraalkylsodiumaluminate made from olefin mixtures comprising approximately equal portions of normal olefins having six and eight carbon atoms respectively, eight and ten carbon atoms respectively, or ten and twelve carbon atoms respectively. An example of such preparation is using approximately equal portions of 1-hexene and 1-octene to prepare a mixture of tetraalkylsodiumaluminates, wherein the alkyl groups are hexyl and octyl groups. Such tetraalkysodiumaluminates can then be used to produce a phenyltrialkylsilane product mixture of phenyltrihexylsilane, phenyldihexyloctylsilane, phenylhexyldioctylsilane and phenyltrioctylsilane in an approximately 1:3:3:1 ratio respectively. Such molar ratio can be adjusted by adjusting the olefin ratio used to produce the phenyltrialkylsilanes.

Unexpectedly, such phenyltrialkylsilane compositions, including mixtures of phenyltrialkylsilanes, have better than expected lubrication properties compared to known tetraalkylsilanes. For example, the embodied phenyltrialkylsilanes have demonstrated similar oxidation onset temperatures to that of methyltrialkylsilanes but have lower energy release heat properties, indicating a greater resistance to oxidation.

For example, analysis using SPU methodology of two samples of methyltridecylsilane produced the following table:

TABLE I

| | MethylSiDecyl$_3$ | |
|---|---|---|
| | Sample 1 | Sample 2 |
| Acid # D974 | 0.14 mgKOH/g | 0.02 mgKOH/g |
| Acid # TBAH | 0.00 mgKOH/g | 0.00 mgKOH/g |
| DSC Onset Temp. | 198.5° C. | 198.6° C. |
| COC Flash Point | 236° C. | 236° C. |
| Pour Point | −51° C. | −54° C. |
| Viscosity at 100° C. | 3.56 cSt | 3.53 cSt |
| Olefin | N.D. | N.D. |
| SiH | N.D. | N.D. |
| $H_2O$ | 18 ppm | 17 ppm |

N.D. = None detected in analysis

Analysis of samples of phenyltrihexylsilane and mixtures of trialkylphenylsilanes wherein the alkyl groups were hexyl, oxtyl, decyl and dodecyl groups are reproduced in the following table:

TABLE II

| | PhenylSiR$_3$ Fluids | | | |
|---|---|---|---|---|
| SAMPLES | (A) | (B) | (C) | (D) |
| R-Groups | $C_6$ | $C_6/C_8$ | $C_8/C_{10}$ | $C_{10}/C_{12}$ |
| Viscosity at 40° C. | 9.19 cSt | 14.2 cSt | 20.3 cSt | 28.8 cSt |
| Viscosity at 100° C. | 2.42 cSt | 3.36 cSt | 4.45 cSt | 5.95 cSt |
| Viscosity Index | 74 | 108 | 134 | 158 |
| Pour Point | <−65° C. | <−65° C. | <−65° C. | −27° C. |
| Oxidation Onset | 197.4° C. | 196.0° C. | (192.5° C.)* | 196.3° C. |

*Value may be lower because of unknown artifacts in analysis.

Further analysis of the above four samples (A, B, C and D) are given in the following tables:

SAMPLE A
COMPOSITION
Phenyltrihexylsilane
Product Physical Properties

| Property | Value (Duplication value) |
|---|---|
| Oxidation Onset Temperature (°C.) | 197.4 C. |
| Energy (kJ/g) | 7.5 kJ/g |
| Viscosity (cSt) at | |
| −54° C. | |
| −40° C. | 1030 |
| +40° C. | 9.27 |
| +100° C. | 2.47 |
| Pour Point (°C.) | <−65 |
| Specific Gravity at | |
| 15.6° C. | 0.8694 |
| 25° C. | 0.8652 |
| Temperature (°C.) at weight loss of | |
| 5% | 191.5 C. |
| 50% | 248.9 C. |
| 95% | 273.6 C. |
| Weight Loss (%) at temperatures of | |
| 100.00 C. | 0.00 |
| 200.00 C. | 7.6 |
| 300.00 C. | 99.3 |
| 400.00 C. | 99.4 |
| 500.00 C. | 99.5 |
| Analysis in air, temperature (°C.) at weight loss of | |
| 5% | 194.9 C. |
| 50% | 248.6 C. |

-continued

SAMPLE A
COMPOSITION
Phenyltrihexylsilane
Product Physical Properties

| Property | Value (Duplication value) |
|---|---|
| 95% | 302.6 C. |
| Weight Loss % at temperatures of | |
| 200.00 C. | 6.4 |
| 300.00 C. | 95.0 |
| 400.00 C. | 96.7 |
| 500.00 C. | 96.8 |
| Viscosity Index | 84.1 |

SAMPLE B
Composition
Mixture of -
1 part phenyltrihexylsilane
3 parts phenyldihexyloctylsilane
3 parts phenylhexyldioctylsilane
1 part phenyltrioctylsilane
Product Physical Properties

| Property | Value (Duplication value) |
|---|---|
| Oxidation Onset Temperature (°C.) | 196.0 C. |
| Energy (kJ/g) | 8.5 kJ/g |
| Viscosity (cSt) at | |
| −54° C. | 11400 |
| −40° C. | 2120 |
| +40° C. | 14.2 |
| +100° C. | 3.36 |
| Pour Point (°C.) | <−65° C. |
| Specific Gravity at | |
| 15.6° C. | 0.8715 |
| 25° C. | 0.8673 |
| Weight Loss (%) at temperatures of | |
| 100.00 C. | 0.0% |
| 200.00 C. | 1.5% |
| 300.00 C. | 64.3% |
| 400.00 C. | 98.9% |
| 500.00 C. | 99.4% |
| Temperature (°C.) at weight loss of | |
| 5% | 223.9 C. |
| 50% | 289.9 C. |
| 95% | 343.6 C. |
| Analysis in air, weight loss (%) at temperatures of | |
| 100 C. | 0.0% |
| 200.00 C. | 2.3% |
| 300.00 C. | 79.3% |
| 400.00 C. | 88.8% |
| 500.00 C. | 91.3% |
| Analysis in air, temperature (°C.) at weight loss of | |
| 5% | 214.3 C. |
| 50% | 270.9 C. |
| 95% | >500.0 C. |
| Viscosity Index | 108 |

SAMPLE C
Composition
Mixture of -
1 part phenyltrioctylsilane
3 parts phenyldioctyldecylsilane
3 parts phenyloctyldidecylsilane
1 part phenyltridecylsilane
Product Physical Properties

| Property | Value (Duplication value) |
|---|---|
| Oxidation Onset Temperature (°C.) | 192.3 C. |
| Energy (kJ/g) | 9.0 kJ/g |
| Viscosity (cSt) at | |
| −54° C. | 20200 |
| −40° C. | 3460 |
| +40° C. | 20.9 |

-continued

| SAMPLE C<br>Composition<br>Mixture of -<br>1 part phenyltrioctylsilane<br>3 parts phenyldioctyldecylsilane<br>3 parts phenyloctyldidecylsilane<br>1 part phenyltridecylsilane<br>Product Physical Properties | |
|---|---|
| Property | Value (Duplication value) |
| +100° C. | 4.59 |
| Pour Point (°C.) | <−65° C. |
| Specific Gravity at | |
| 15.6° C. | 0.8664 |
| 25° C. | 0.8622 |
| Temperature (°C.) at weight loss of | |
| 5% | 276.3 C. |
| 50% | 339.6 C. |
| 95% | 383.5 C. |
| Weight Loss (%) at temperatures of | |
| 100.00 C. | 0.0% |
| 200.00 C. | 0.0% |
| 300.00 C. | 13.5% |
| 400.00 C. | 96.8% |
| 500.00 C. | 99.4% |
| Analysis in air, temperature (°C.) at weight loss of | |
| 5% | 249.0 |
| 50% | 313.7 |
| 95% | >500.0 |
| Analysis in air, weight loss % at temperatures of | |
| 200.00 C. | 0.2% |
| 300.00 C. | 30.7% |
| 400.00 C. | 81.7% |
| 500.00 C. | 87.8% |
| Viscosity Index | 140 |

| SAMPLE D<br>Composition<br>Mixture of -<br>1 part phenyltridecylsilane<br>3 parts phenyldidecyldodecylsilane<br>3 parts phenyldecyldidodecylsilane<br>1 part phenyltridodecylsilane<br>Product Physical Properties | |
|---|---|
| Property | Value (Duplication value) |
| Oxidation Onset Temperature (°C.) | 196.3 C. |
| Energy (kJ/g) | 10.8 kJ/g |
| Viscosity (cSt) at | |
| −54° C. | — |
| −40° C. | — |
| +40° C. | 28.8 |
| +100° C. | 5.95 |
| Pour Point (°C.) | −27° C. |
| Specific Gravity at | |
| 15.6° C. | — |
| 25° C. | — |
| Temperature (°C.) at weight loss of | |
| 5% | 286.4 C. |
| 50% | 358.5 C. |
| 95% | 430.4 C. |
| Weight Loss (%) at temperatures of | |
| 100.00 C. | 0.0% |
| 200.00 C. | 0.1% |
| 300.00 C. | 8.3% |
| 400.00 C. | 90.8% |
| 500.00 C. | 98.9% |
| Analysis in air, weight loss % at temperatures of | |
| 200.00 C. | — |
| 300.00 C. | — |
| 400.00 C. | — |
| 500.00 C. | — |
| Analysis in air, temperature (°C.) at weight loss of | |

-continued

| SAMPLE D<br>Composition<br>Mixture of -<br>1 part phenyltridecylsilane<br>3 parts phenyldidecyldodecylsilane<br>3 parts phenyldecyldidodecylsilane<br>1 part phenyltridodecylsilane<br>Product Physical Properties | |
|---|---|
| Property | Value (Duplication value) |
| 5% | — |
| 50% | — |
| 95% | — |
| Viscosity Index | 158 |

The following experiments illustrate embodiments of the invention, but are not intended to limit the scope of the invention herein.

ILLUSTRATIONS OF PREPARATION METHODS

(A) Preparation of Tetraalkylaluminate Reactant

In a nitrogen atmosphere glovebox, alpha-olefin(s) is(are) admixed with sodium aluminum hydride using a 4 to 1 molar ratio, or better yet, using an 8 to 1 molar ratio in an autoclave. Also added to the mixture is lithium aluminum hydride in a 1 to 10 molar ratio as compared to the moles of sodium aluminum hydride added. Lithium aluminum hydride is added as a catalyst for the alkylation of sodium aluminum hydride. The reactants are reacted under the following ramping cycles:

Initial set point: 25° C.

Ramp 1: 25° C. to 125° C. for 1 hour (+1.67° C./minute rate)

Hold 1: Hold at 125° C. for 2 hours

Ramp 2: 125° C. to 175° C. i 30 minutes (+1.67° C./minute rate)

Hold 2: Hold at 175° C. for 3 to 5 hours

Ramp 3: 175° C. to 20° C. (autoclave cool down)

Best results are obtained when the reactants are continuously agitated at a moderate rate. Cooling lines are also required in order for the reaction vessel to maintain temperatures during holds, and not to exceed set point temperatures during ramping.

After reacting under the heating cycle, the aluminate is a grayish-black viscous liquid. Aluminum and gas evolution analyses are used to determine the conversion of sodium aluminum hydride to tetraalkylate.

(B) Preparation of the Silahydrocarbon

The tetraalkylaluminate product is admixed with a tetrahalosilane, or an organo-trihalosilane. The mole ratio of contained sodium tetraalkylaluminate is equal to or substantially equal to 0.75 to 1.0 to 1.0 to 1.0. The reaction was is reacted using the following heating cycles with continuous moderate stirring:

Initial set point: 25° C.

Ramp 1: 25° C. to 60° C. in 35 minutes (+1.0° C./min.)

Hold 1: Hold at 60° C. for 1 hour

Ramp 2: 60° C. to 125° C. in 30 minutes (+2.2° C./min.)

Hold 2: Hold at 125° C. for 1 hour

Ramp 3: 125° C. to 190° C. in 30 minutes (+2.2° C./min.)

Hold 3: Hold at 190° C. for 4 to 5 Hours

Ramp 4:25 minute ramp to 15° C. (autoclave cooling)

After the autoclave has cooled to well below 50° C., the reaction product can be recovered from the autoclave and worked up. The product is worked up in this manner:

The reaction product is first hydrolyzed under nitrogen using aqueous sodium hydroxide. After hydrolysis, the reaction product is then washed several times with water in order to remove any sodium hydroxide or salts still present with the product. After the water washings, the product is dried over $MgSO_4$. The product can then be isolated by distillation under reduced atmospheric pressure and temperatures up to 200° C. The by-products which can be removed and are present with the reaction product could include dimer olefin, or reduced silanes including $R'SiR_2H$ or $R'SiRH_2$. Heavier siloxanes ($R'R_2Si—O—SiR_2R'$) species may be produced after the hydrolysis with the sodium hydroxide, but cannot be removed by distillation unless the product can be distilled away from it.

Purification to afford a water white (clear) product includes passing the product through a column of silica gel and/or basic activated alumina.

EXPERIMENT 1

This reaction was conducted in substantial accordance with the general procedure as stated above. 4.90 moles of 1-hexene, 0.5 moles of sodium aluminum hydride (mole ratio of 10 to 1), and 0.05 moles of lithium aluminum hydride as a catalyst were admixed together. The mixture was heated in a one-liter Parr autoclave according to the heating cycle outlines in the general procedure.

The product was analyzed and found to be 3.55 wt % $Al^{3+}$ with 0.15 mmol/g $H_2$ evolution.

The sodium tetraalkylaluminate product was subsequently reacted with 0.53 moles of phenyl trichlorosilane in a one-litter Parr autoclave using the heating cycle outlined above.

After reaction, the reaction product was hydrolyzed in 900 milliliters of 25% aqueous sodium hydroxide. The hydrolysis was achieved by dripping the product into the caustic with rapid stirring. Product was separated from the caustic was and then washed several times with water. The product was dried over $MgSO_4$ and then isolated away from reaction by-products by distillation at 150°-160° C. under 0.2 to 0.1 mmHg vacuum pressure. Final purification included a passing the product through a silica gel column.

Gas Chromatography (GC) analysis of the initial reaction product after water wash, but before distillation, showed a 59 to 4 ratio of the desired phenyl tri-n-hexylsilane product to the undesired reduced by-product phenyl di-n-hexylsilane.

EXPERIMENT 2

This experiment was conducted in general accordance with the procedure described above for the preparation of silahydrocarbon from sodium tetraalkylaluminates. Using 0.412 moles sodium tetra(octyl/decyl) aluminate, created by using a one to one molar alpha-olefin mixture of 1-octene to 1-decene in the aluminate production step, and 0.46 moles of phenyl trichlorosilane as reactants in a one-liter Parr autoclave, an octyl/decyl silahydrocarbon mixture was produced. The reactants were reacted using the heating cycle outlined above to create a mixture of tetraalkylsilahydrocarbons which includes phenyltrioctylsilane, phenyldioctyldecylsilane, phenyldidecyloctylsilane and phenyltridecylsilane.

A GC analysis of the reaction product showed the following distribution of silahydrocarbons:

| | |
|---|---|
| $(C_6H_5)Si(C_8H_{17})_3$ | 7.8 area % |
| $(C_6H_5)Si(C_8H_{17})_2(C_{10}H_{21})$ | 24.2 area % |
| $(C_6H_5)Si(C_8H_{17})(C_{10}H_{21})_2$ | 23.2 area % |
| $(C_6H_5)Si(C_{10}H_{21})_3$ | 7.4 area % |

The product was worked up in a similar manner to the procedure outlined above. The product mix was hydrolyzed in caustic, washed with water, and dried over $MgSO_4$. The silahydrocarbon product was isolated by distillation under 0.1 mmHg vacuum pressure and up to 200° C. temperatures. Additional isolation of the product included Kugelrohr distillation in the final isolation steps. Final purification included passing the product through a silica gel/alumina column.

EXPERIMENT 3

This procedure was performed in accordance to the general procedure as outlined above for the preparation of sodium tetraalkylaluminate and its subsequent conversion to tetraalkylsilahydrocarbon. 2 moles of 1-decene and 2 moles of 1-dodecne were admixed together. 3.13 moles of the alpha-olefin mixture was decanted into a one-liter Parr autoclave under a glovebox. To the olefins were added 0.391 moles of sodium aluminum hydride and 0.039 moles of lithium aluminum hydride. The reactants were reacted using the heating cycle outlined above to produce the decyl/dodecyl tetraalkylaluminate. Analysis of the aluminate showed 2.22 wt % $Al^{3+}$ with no gas evolution, thus indicating a complete conversion to the tetraalkylaluminate.

The aluminate was then admixed with 0.437 moles of phenyl trichlorosilane in accordance to the procedure stated above. These two reactants were reacted using the heating cycle listed above for the silahydrocarbon general procedure.

The reaction product was analyzed by GC after the wash solvents were removed by distillation. The results of the analysis showed the following ratio of silahydrocarbons:

| | |
|---|---|
| $(C_6H_5)Si(C_{10}H_{21})_3$ | 8.3 area % |
| $(C_6H_5)Si(C_{10}H_{21})_2(C_{12}H_{25})$ | 21.2 area % |
| $(C_6H_5)Si(C_{10}H_{21})(C_{12}H_{25})_2$ | 18.8 area % |
| $(C_6H_5)Si(C_{12}H_{25})_3$ | 6.0 area % |

The product was isolated by distillation under 0.1 mmHg vacuum pressure and at temperatures up to 200° C. Kugelrohr distillation was also employed to isolate the product. Final purification was achieved by passing the product through a silica gel/alumina column.

EXPERIMENT 4

The procedure was conducted in general accordance with the procedure described above. 0.364 moles of hexyl/octyl aluminate and 0.404 moles of phenyl trichlorosilane were admixed together. These reactants were then loaded into a one-liter Parr autoclave and heated according to the cycle outlined above for the preparation of a silahydrocarbon.

The product mix was hydrolyzed in caustic, washed several times with water, and then dried over $MgSO_4$. After distilling away solvents and low molecular weight impurities such as solvent olefin and olefin dimer, the reaction product was analyzed by GC. The GC analysis showed the following proportion of silahydrocarbons:

| | |
|---|---|
| $(C_6H_5)Si(C_6H_{13})_3$ | 8.9 area % |
| $(C_6H_5)Si(C_6H_{13})_2(C_8H_{17})$ | 21.8 area % |
| $(C_6H_5)Si(C_6H_{13})(C_8H_{17})_2$ | 22.4 area % |
| $(C_6H_5)Si(C_8H_{17})_3$ | 7.5 area % |

The product was isolated by distillation under 0.1 mmHg vacuum pressure and temperatures up to 200° C. The final purification step included passing the product through a column of silica gel.

EXPERIMENT 5

A mixture of phenyltrihexylsilane, phenyldihexyloctylsilane, phenylhexyldioctylsilane, and phenyltrioctylsilane was prepared. Differential scanning calorimetry of these materials under 500 psig oxygen disclosed these compounds as having oxidation onset temperatures roughly equivalent to methyltrialkylsilanes; however, energy release during oxidation occurred at a much lower rate for the phenyl compounds. FIG. 1 is a graph showing the differential scanning calorimetry results and demonstrates the total energy as represented by the area under the curves and the energy release rate as represented by the curve height. The curve designated as "A" is the result of the analysis of 2.2800 mgs of the phenyltrialkylsilane mixture. The curve designated as "B" is result of the analysis of 2.2900 mgs of methyltrialkylsilane. The figure illustrates a lower heat flow rate for the phenyltrialkylsilane mixture as compared to the methyltrialkylsilane mixture as well as lower total Joules per gram of material.

What is claimed is:

1. A lubricant composition comprising a mixture of phenyltrialkylsilanes having the formula $RSi(R')_n(R'')_{3-n}$ wherein R is a phenyl group and R' and R'' are each independently selected from normal alkyl groups having from about four to about sixteen carbon atoms and n is one, two or three, and wherein the number of carbon atoms in R' and R'' differ by at least about two.

2. The composition in claim 1 wherein the number of carbon atoms in R' and R'' differ by about two.

3. The composition in claim 1 comprising $aRSi(R')_3$, $bRSi(R')_2(R'')_1$, $cRSi(R')_1(R'')_2$ and $dRSi(R'')_3$, wherein a, b, c and d represent the ratio of the phenyltrialkylsilanes in the mixture.

4. The composition in claim 3 wherein a and d are approximately equal and b and c are approximately equal and greater than a or d.

5. The composition in claim 4 wherein the ratio a:b:c:d is about 1:05 to 15:0.5 to 15:0.5 to 2.

6. The composition in claim 5 wherein the ratio a:b:c:d is about 1:3:3:1.

7. The composition in claim 1 wherein the phenyltrialkylsilanes comprise the reaction product of olefin mixtures comprising approximately equal portions of normal olefins having six and eight carbon atoms respectively, eight or ten carbon atoms respectively, or ten or twelve carbon atoms respectively; sodium aluminum hydride; and tetrahalosilane or organo-trihalosilane.

* * * * *